US010508406B1

(12) United States Patent
Childress et al.

(10) Patent No.: US 10,508,406 B1
(45) Date of Patent: Dec. 17, 2019

(54) SYSTEMS AND METHODS FOR INSTALLING AND STABILIZING A PIER

(71) Applicant: Tella Firma, LLC, Richardson, TX (US)

(72) Inventors: Tony H. Childress, Plano, TX (US); Steven Pingree, Garland, TX (US); James Fontaine, Plano, TX (US)

(73) Assignee: Tella Firma, LLC, Richardson, TX (US)

( * ) Notice: Subject to any disclaimer, the term of this patent is extended or adjusted under 35 U.S.C. 154(b) by 0 days.

(21) Appl. No.: 16/263,245

(22) Filed: Jan. 31, 2019

Related U.S. Application Data

(62) Division of application No. 15/232,170, filed on Aug. 9, 2016, now abandoned.

(51) Int. Cl.

| | |
|---|---|
| ***E02D 27/34*** | (2006.01) |
| ***E02D 31/10*** | (2006.01) |
| ***B66F 3/08*** | (2006.01) |
| ***E02D 5/56*** | (2006.01) |
| ***E02D 3/12*** | (2006.01) |
| ***E02D 27/32*** | (2006.01) |
| ***E02D 35/00*** | (2006.01) |
| ***E02D 7/00*** | (2006.01) |
| ***E02D 5/22*** | (2006.01) |
| *E02D 7/22* | (2006.01) |

(52) U.S. Cl.
CPC ..... *E02D 31/10* (2013.01); *B66F 3/08* (2013.01); *E02D 3/12* (2013.01); *E02D 5/223* (2013.01); *E02D 5/56* (2013.01); *E02D 7/00* (2013.01); *E02D 27/32* (2013.01); *E02D 27/34* (2013.01); *E02D 35/005* (2013.01); *E02D 7/22* (2013.01)

(58) Field of Classification Search
CPC ..... E02D 27/34
USPC ..... 405/230; 52/126.4–126.7
See application file for complete search history.

(56) References Cited

U.S. PATENT DOCUMENTS

| | | | | |
|---|---|---|---|---|
| 2,322,855 A | | 6/1943 | Lenahan | |
| 3,710,523 A | | 1/1973 | Taylor | |
| 4,258,516 A | * | 3/1981 | Mori | E04F 15/02476 52/126.6 |

(Continued)

FOREIGN PATENT DOCUMENTS

| | | | |
|---|---|---|---|
| CA | 2628422 A1 | | 2/2007 |
| GB | 1422772 A | * | 1/1976 |
| WO | WO 2017061882 A1 | * | 4/2017 |

*Primary Examiner* — Sunil Singh
(74) *Attorney, Agent, or Firm* — Norton Rose Fulbright US LLP

(57) ABSTRACT

A device for stabilizing a metal pier installed in the ground. The device includes a device to provide lateral support to the pier and a shaft configured so that a force imposed, parallel to an axis of the pier, on the device is not imposed on the pier. A method of stabilizing a pier installed in ground to support a structure. The method includes determining the location of an unstable soil zone of the ground and a stable soil zone of the ground. The method also includes placing a stabilizing plate in the unstable soil zone to provide lateral support to the pier. A device configured to lift a foundation slab above the ground. The device includes a lifting bolt and apparatus that restricts lateral deflection of the pier when a torque is applied to the lifting bolt to raise the slab. A method of stabilizing soil around a pier.

11 Claims, 11 Drawing Sheets

(56) References Cited

U.S. PATENT DOCUMENTS

| | | | | |
|---|---|---|---|---|
| 4,348,841 | A * | 9/1982 | Ueno | E04D 3/351 52/126.5 |
| 4,373,307 | A | 2/1983 | Evans | |
| 4,906,140 | A | 3/1990 | Clark | |
| 5,575,593 | A | 11/1996 | Raaf | |
| 5,791,097 | A | 8/1998 | Winston et al. | |
| 5,934,036 | A | 8/1999 | Gallagher, Jr. | |
| 6,050,207 | A | 4/2000 | Mays | |
| 6,206,615 | B1 | 3/2001 | Adsbøll | |
| 6,722,821 | B1 | 4/2004 | Perko et al. | |
| 6,923,599 | B2 | 8/2005 | Kelso | |
| 7,556,453 | B2 | 7/2009 | Collina et al. | |
| 7,823,341 | B2 | 11/2010 | Kelly et al. | |
| 8,069,620 | B2 | 12/2011 | Kelly et al. | |
| 8,407,898 | B2 | 4/2013 | Marshall | |
| 8,458,984 | B2 | 6/2013 | Marshall | |
| 8,671,627 | B2 | 3/2014 | Marshall | |
| 8,678,712 | B2 | 3/2014 | Marshall | |
| 8,834,072 | B1 | 9/2014 | Donald | |
| 10,294,628 | B1 * | 5/2019 | Childress | E02D 35/005 |
| 2002/0062622 | A1 | 5/2002 | Bell et al. | |
| 2004/0037653 | A1 | 2/2004 | Kelso | |
| 2006/0067794 | A1 | 3/2006 | Mitchell | |
| 2007/0028557 | A1 * | 2/2007 | Kelly | E02D 27/34 52/741.15 |
| 2010/0011698 | A1 | 1/2010 | Fearn | |
| 2011/0052329 | A1 | 3/2011 | Marshall | |
| 2011/0116873 | A1 | 5/2011 | Marshall et al. | |
| 2012/0114423 | A1 | 5/2012 | Zago et al. | |
| 2012/0288335 | A1 | 11/2012 | Green | |
| 2016/0032554 | A1 | 2/2016 | Hicks | |

* cited by examiner

SYSTEMS AND METHODS FOR INSTALLING AND STABILIZING A PIER

CROSS-REFERENCE TO RELATED APPLICATION

The present application is a division of U.S. patent application Ser. No. 15/232,170, filed Aug. 9, 2016 and entitled, "SYSTEMS AND METHODS FOR INSTALLING AND STABILIZING A PIER," the disclosure of which is incorporated by reference herein in its entirety.

TECHNICAL FIELD

The present application relates to narrow (outer dimension <6") manufactured metal piers installed in the ground to support structures. More specifically, the application relates to systems and methods of installing and stabilizing metal piers.

BACKGROUND OF THE INVENTION

The quality of a structure, whether it is a house, apartment building or commercial office building, is inextricably tied to its foundation. If the structure is not built on a proper foundation, the rest of the structure, even if properly constructed, is likely to show defects over time. When foundations are constructed directly on soils or on the ground, it creates an unstable environment for the foundation. In addition, if these soils are active or expansive, the environment may be especially problematic. For example, in regions where the soil has a high percentage of active clay, expansion and contraction of the clay subjects the foundations to significant loads (forces) and potential movement.

Structures built on soils in certain regions may have had their slab foundations and walls displaced and damaged (e.g. foundations and walls cracked) as a result of differential expansion and/or contraction of the soil. This damage, not surprisingly, creates consternation for the home or building owner and, in turn, other parties such as the developer, the builder, the salesperson, and insurer of the structure. Often, litigation ensues amongst these parties. Over time, engineers developed systems and methods for designing foundations in an attempt to minimize damage due to movement of soils. Some of these system and methods include very heavy slabs which include extensive steel reinforcement and large concrete beams in the slab; injection of water to cause pre-installation expansion of soils, injection of stabilizing chemicals to cause pre-installation expansion and stabilization of soils; installation of piers (piles) to stabilize the slab and prevent the slab from dropping should the soils contract; isolation of the slab from the active soils by suspending the slab above the ground with the use of piers and void space under the slab. In addition, systems and methods have been developed to repair and isolate the slab foundations from the active soils after such movement of the soil has occurred.

The installation of piers to suspend or lift the slab foundation to create a protective void between the soil and the slab foundation is a solution that is commonly applied. This method may also mitigate some slab foundation failures caused by seismic activity such as earthquakes and tremors, as such seismic activity, too, causes the soil to move in a manner that can damage a slab foundation. U.S. Pat. No. 7,823,341, HEIGHT-ADJUSTABLE, STRUCTURALLY SUSPENDED SLABS FOR A STRUCTURAL FOUNDATION, issued Nov. 2, 2010 ('341 Patent), which is incorporated by reference herein, discloses a method of lifting a foundation by piers.

There are several types of pier or piles used in foundation construction including poured concrete piers, metal helical piers, metal pressed or pile driven piers. The most common pier in residential and commercial building construction is the poured concrete pier. The typical diameter of a concrete pier is 12" to 24", however 36" diameter piers or larger can be specified in very heavy designs such as multistory garages. When designing a foundation on piers, two load factors for the piers must be considered: axial load and lateral load. Axial load is caused by the live and dead loads of the structure and the contents of the structure which put vertical load on the piers while lateral load is caused by horizontal loads on the structure that transfers to the piers such as wind loads on the structure. A 12 inches to 24 inches diameter concrete pier typically has sufficient amount of lateral strength to withstand the lateral loads that can be transferred from the structure. However, metal helical or pressed piers have a much narrower out-to-out dimension (typically <6 inches) and therefore may not have sufficient lateral strength to withstand the lateral loads. In these cases, a method may be implemented to increase the lateral capacity of a metal pier.

FIG. 1 shows a prior art system for suspending slab foundations as described in the '341 Patent. As the '341 Patent describes, prior to forming slab foundation 16, piers 10 are installed into ground 15. Metal helical piers 10 include shafts 11 attached to helixes 12. Piers 10 may be installed by applying a torque to shafts 11, which causes helixes 12 to drill into ground 15 to a desired depth, usually a depth to provide proper load bearing capacity. Lifting mechanisms 13 are installed on top of piers 10. Concrete is then poured within form boards that are placed to define the perimeter of slab foundation 16. Once the concrete is poured to cast slab foundation 16, it is allowed to cure. As the concrete cures and strengthens, it fixes to lifting mechanism 13, which, as noted above, sits on top of pier 10.

After slab foundation 16 is formed on ground 15, lifting mechanisms 13 are used to lift slab foundation 16 to a desired height above ground 15, thereby creating void 14 between ground 15 and slab foundation 16. Lifting mechanisms 13 include lifting bolts 17. To lift slab foundation 16, torque is applied to lifting bolts 17, screwing them into and through nuts 18 until lifting bolts 17 make contact with lifting plates 19, which rests on top of piers 10. On application of sufficient torque, lifting bolts 17 turn on lifting plate 19 until it lifts slab 16 up from ground 15. As lifting mechanism 13 lifts slab foundation 16, void 14 is created. After the lifting of slab foundation 16, ground 15 is able to expand into void 14. Thus, with void 14 in place, expansion of ground 15 does not cause an upward load on slab foundation 16.

If narrow metal piers are used and it is determined that they will not have sufficient lateral capacity to withstand lateral loads, the metal piers may be pre-stabilized before the slab is constructed. A common method to stabilize a metal pier is to pour concrete around the top of the helical to form a concrete cap to the metal pier. This concrete cap is designed to increase the lateral capacity of the metal pier by keeping it from buckling, moving or bending under lateral loads. When the soil is active, however, placing stabilizing devices in it may cause more problems than it solves. Specifically, expansion of the active soil may push the stabilizing device upwards (e.g. a concrete cap), causing the pier and the load it is supporting (e.g. house) to be displaced upwards.

As noted above, a separate method of preventing damage to slab foundations caused by movement of active soil is to treat the soils with either water or chemicals in an attempt to stabilize the soils. Moisture conditioning or water injection is used to wet the soil thereby cause pre-swelling of the soil. Once the soil has been treated with water and it has expanded, plastic is placed over the soil in an attempt to maintain the moisture condition. Chemical injection of the soils is used to modify the properties of the soil. For example, these chemicals change the ability of clay to expand or contract depending on the amount of water present in the clay. The chemicals adjust the clay's inherent capacity to expand as its water content increases and to contract as its water content decreases. An example of a chemical composition used to modify the properties of soil and in order to stabilize the soil is disclosed in US Patent Pub. No. Application No. 2012/0288335 ('335 Application), filed May 11, 2012 by Rodney Green. The systems and methods of stabilizing soil by compositions added to soil disclosed by the '335 Application is incorporated herein by reference. However, it should be noted that compositions other than those disclosed in the '335 Application may be used in embodiments of the invention described herein.

The composition disclosed in the '335 Application, when added to soil, creates an exchange of ions that changes the molecular structure of the soil. This change in structure prevents the soil from absorbing water. Thus, the movement of soil caused by its contraction and expansion due to changes in water content is eliminated.

BRIEF SUMMARY OF THE INVENTION

Although suspending slab foundations on piers above the ground to create a protective void between the ground and the slab foundations works well, implementing it has its challenges. As noted above, there is difficulty in stabilizing a metal pier against lateral loads in unstable soil. Metal piers have a tendency to deflect, bend or buckle when a lateral load is applied to it. The metal piers have a limited capacity to withstand lateral loads because of how they are installed or simply because of the lack of stiffness due to the smaller out-to-out dimension (e.g. the diameter of a circular cross section or longest diagonal length of a polygonal cross section) of the pier shaft. An additional difficulty is that, in the lifting process described above, a torque applied to lifting bolt 17 may cause deflection or buckling of metal pier 10 as lifting bolt 17 turns on top of lifting plate 19. As a result, lifting bolt 17 may become misaligned with the vertical axis of metal pier 10 (i.e. the force applied to metal pier 10 is off center, resulting in a lateral force vector component being applied to metal pier 10). Metal pier 10 and lifting plate 19, and, in extreme situations, lifting bolt 17 slides off lifting plate 19. Thus, the deflection of metal pier 10 during lifting of slab foundation 16 could cause buckling, of metal pier 10 due to the application of a non-concentric load on pier 10. Additionally, if one or more of lifting bolts 17 slides off its respective lifting plate 19 due to pier deflection, the loss of support at certain areas of slab foundation 16 could severely damage slab foundation 16, or the structure it supports, or both.

Embodiments of the present invention are directed to systems and methods that configure a stabilizing device so that it can be installed in unstable soil (e.g. active soil or sandy soil) to stabilize piers against lateral loads, while preventing or minimizing vertical loads on the pier that may be imposed on the stabilizing device. Systems and methods described herein also stabilize a lifting bolt or other lifting mechanism in relation to the pier, in either unstable (e.g. active) or stable soil (e.g. inactive) conditions, during the lifting of a load on piers by providing a boundary to constrain the tendency of the lifting mechanism and pier to dislocate laterally from each other.

Embodiments of the invention involve configuring a stabilizing device used to provide lateral stability such that lateral loads imposed on a metal pier (e.g. loads caused by seismic action or wind on the structure the metal pier is supporting, which causes a lateral force vector on the metal pier) are transmitted to the stabilizing device; however, a vertical load imposed on the device is not imposed on the metal pier. Alternatively, in embodiments of the invention, when a vertical load is imposed on the stabilizing device, transmission of that load to the metal pier is minimized such that a vertical load on the metal pier from the stabilizing device does not exceed a pre-determined amount. In embodiments of the invention, the stabilizing device includes a helix.

Embodiments of the invention include configuring a stabilizing device for a metal pier so that a load applied to the stabilizing device that is parallel to the axis of a shaft of the metal pier (e.g. a vertical axis for a vertical pier) moves the stabilizing device in a direction parallel the axis (e.g. vertically for a vertical pier), without transferring that load to the metal pier. However, the stabilizing device is further adapted such that when a lateral load is applied to the metal pier, that load is transferred to the stabilizing device. In turn, the stabilizing device in cooperation with soil in which the stabilizing device is disposed prevents, reduces, or minimizes lateral displacement of the metal pier.

More specifically, embodiments of the invention include a stabilizing device that has a stabilizing plate adapted to provide lateral support to the metal pier. The stabilizing device of embodiments further includes a shaft to which the stabilizing plate is attached. The shaft is configured so that a force imposed, parallel to an axis of the metal pier, on the stabilizing device, is not imposed on the metal pier.

Embodiments of the invention also include a method of stabilizing a metal pier disposed in the ground for supporting a structure. The method may include installing the metal pier in the ground. The method may further include placing a stabilizing plate in the unstable soil zone to provide lateral support to the metal pier.

Embodiments of the invention further include a system for supporting a structure. The system includes a metal pier disposed in the ground such that the metal pier extends from the structure to a stable soil zone of the ground. To stabilize the metal pier further, the system includes a stabilizing plate in an unstable soil zone of the ground, where the stabilizing plate is adapted to provide lateral support to the metal pier.

Embodiments of the invention also include a lifting mechanism for lifting a slab from the ground. The lifting mechanism includes a lifting bolt and apparatus adapted to restrict lateral displacement between the lifting bolt and the pier when a torque is applied to the lifting bolt to raise the slab.

Embodiments of the present invention stabilize unstable soil, or to guard against stable soil becoming unstable in the future, in which a metal pier is disposed, in order to eliminate or minimize movement of the metal pier due to soil movement. According to embodiments of the invention, a metal pier is stabilized by injecting a stabilizing fluid, through the metal pier itself, into the unstable soil to alter a property of the soil.

Embodiments of the invention include a method of stabilizing a metal pier installed in the ground to support a structure. The method includes installing the metal pier in the ground and then modifying a property of the soil around the metal pier to stabilize the metal pier.

Embodiments of the invention include a metal pier for installation in the ground to support a structure. The metal pier has a shaft with a hollow portion. The hollow portion includes apparatus within it for flowing stabilizing fluid through the shaft and into soil around the shaft.

Embodiments of the invention include a system for supporting a structure. The system includes a metal pier disposed in the ground for supporting the structure. The metal pier has a shaft with a hollow portion. The hollow portion includes apparatus within it for flowing stabilizing fluid through the shaft and into soil around the shaft. The system also includes a supply channel disposed in the structure. The supply channel is in fluid communication with the apparatus.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

BRIEF DESCRIPTION OF THE DRAWINGS

For a more complete understanding of the present invention, reference is now made to the following descriptions taken in conjunction with the accompanying drawing, in which.

DETAILED DESCRIPTION OF THE INVENTION

Embodiments of the present invention provide lateral stability for a load bearing pier disposed in the ground. The piers may support structures that are above, below, or partially above and partially below the ground. These structures may include residential and commercial buildings, light poles, telephone poles, roads, road signs etc. The piers are metallic and may be of various types such as driven piers, helical piers, etc. Further, these piers may be hollow piers, solid piers, round piers, rectangular piers, polygonal piers, the like, and combinations thereof.

According to embodiments of the invention, a stabilizing device (that includes a stabilizing plate) is used to provide lateral support to a pier and to the structure the pier supports. In operation, when a lateral force is imposed on the pier, the pier, in turn, imposes that lateral force on the stabilizing device. Under this lateral force, the stabilizing device, in cooperation with soil surrounding the stabilizing device, stabilizes the pier by preventing or at least restricting lateral movement of the pier. However, a vertical force imposed on the stabilizing device of embodiments is not imposed on the pier. Alternatively, embodiments of a stabilizing device are adapted so that a vertical force imposed on the stabilizing device imposes a relatively small vertical force on the pier (e.g., a vertical force not to exceed a predetermined threshold).

Figure 2:
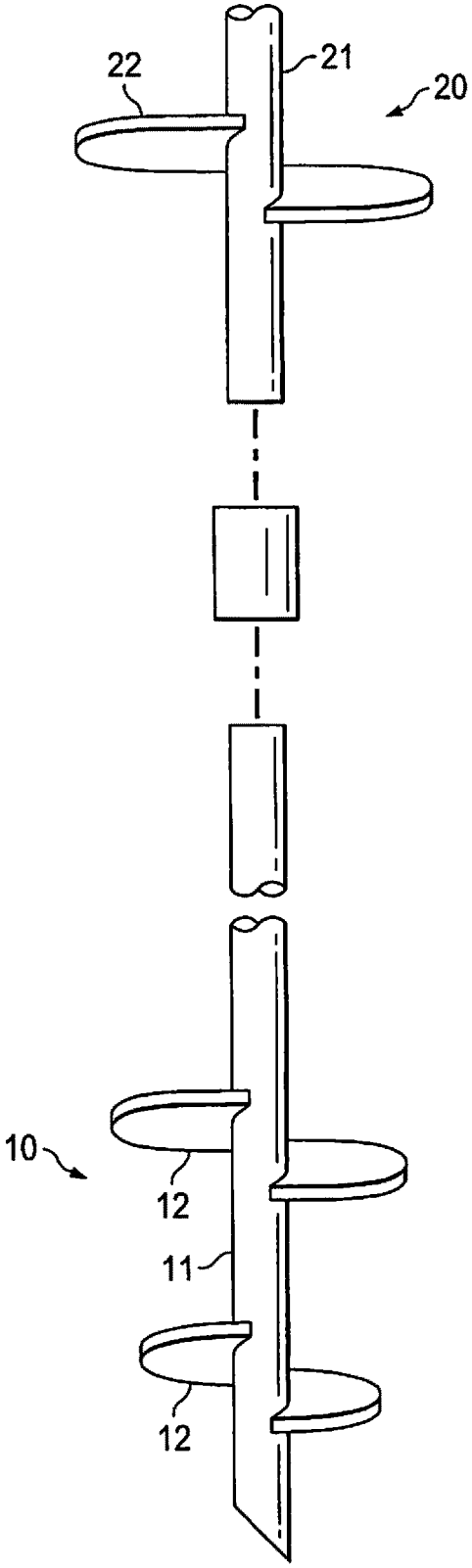
FIG. 2 shows a stabilizing device for attachment to a metal pier according to embodiments of the invention.

FIG. 2 shows a stabilizing device 20 according to embodiments of the invention. Stabilizing device 20 is configured for attachment to a metal pier to provide lateral stabilization support to the metal pier. Stabilizing device 20 and all the other stabilizing devices disclosed herein (e.g. stabilizing devices 30, 40, 70, 80, 90, and 160) may be made of metal (e.g. different types of steel), composite materials (e.g., carbon fiber composites, engineered materials, etc.), polymers and/or the like, and combinations thereof. Stabilizing device 20 includes shaft 21 and helix 22. Helix 22 is a helix shaped plate (blade) that is substantially horizontal and extends radially from shaft 21. To provide lateral support to piers such as pier 10, shaft 21 may be attached to the top of shaft 11 of pier 10. This attachment may be made by various methods such as welding, bolting, clamping, threaded screw etc. However, in embodiments, helix 22 may be attached to shaft 11 directly, without shaft 21. In embodiments, shaft 21 and shaft 11 may be hollow, solid, round, rectangular, polygonal, the like, and combinations thereof. Similarly, in embodiments of the invention, shafts 31, 61, 71, 81, 91, and 161 (discussed below) may be hollow, solid, round, rectangular, polygonal, the like, and combinations thereof. If shaft 21 is a sleeve (hollow pipe), it may capped at one end and have a larger cross section than shaft 11 of pier 10. In this way, shaft 21 can fit (loosely or securely) over shaft 11 of pier 10.

FIG. 2 shows pier 10 having helixes 12 extending radially from shaft 11. Although helix 12 and helix 22 may be somewhat similar in structure, there is a significant distinction between them. Helix 12 represents a conventional use of helixes on a pier, specifically, as a tool to facilitate drilling pier 10 down into the ground. Thus, helix 12 is usually on the lower half or the lowest quarter of pier 10. Conventionally, pier 10 is drilled into the ground until stable soil is reached. At this point, helix 12, in cooperation with the stable soil, provides vertical support to pier 10. This is one of the reasons helix 12 is disposed in stable soil. In contrast, helix 22, according to embodiments of the invention, may be disposed in unstable (e.g. active soil) and used as a stabilizing plate. Thus, helix 22, in practice of embodiments of the invention, is placed near the surface of the ground (e.g. 6 to 24 inches from the surface). Embodiments of the invention ensures that the configuration of helix 22 (e.g. size, operational features etc.), disposed in active soil, is such that an upward or downward expected force due to active soil movement imposes a load that does not exceed a predetermined amount. Although embodiments of the invention are described herein with reference to active soils (e.g. clay) and inactive soils, it should be understood that the embodiments are also applicable to any type of unstable soils (e.g. sandy soils) and any type of stable soils, respectively. "Stable soil" as discussed herein is soil that is not unstable. "Unstable soil" as discussed herein is expansive soil as defined by the IBC 2012 definition of Expansive Soil as follows:

1803.5.3 Expansive Soil.

In areas likely to have expansive soil, the building official shall require soil tests to determine where such soils do exist. Soils meeting all four of the following provisions shall be considered expansive, except that tests to show compliance with Items 1, 2 and 3 shall not be required if the test prescribed in Item 4 is conducted:

1. Plasticity index (PI) of 15 or greater, determined in accordance with ASTM D 4318.

2. More than 10 percent of the soil particles pass a No. 200 sieve (75 μm), determined in accordance with ASTM D 422.

3. More than 10 percent of the soil particles are less than 5 micrometers in size, determined in accordance with ASTM D 422.

4. Expansion index greater than 20, determined in accordance with ASTM D 4829.

The different configurations of stabilizing devices disclosed herein may make a particular stabilizing device more or less suitable for different applications. The different applications may be as a result of, for example, how active or unstable the soil is. In embodiments of the invention, helixes and stabilizing devices disposed in unstable soil to provide lateral stabilization to a metal pier having an out-to-out dimension of 1" to 6" may have a helix diameter of 6 inches to 24 inches and a pitch of between 1 and 3 inches. In embodiments of the invention, a lateral force of 250 to 4,000 lbs. applied to a pier of out-to-out dimension of 1 to 6 inches with a stabilizing device disposed in unstable soil is restricted to displacing the pier from 0 to 1 inch laterally.

Figure 3:
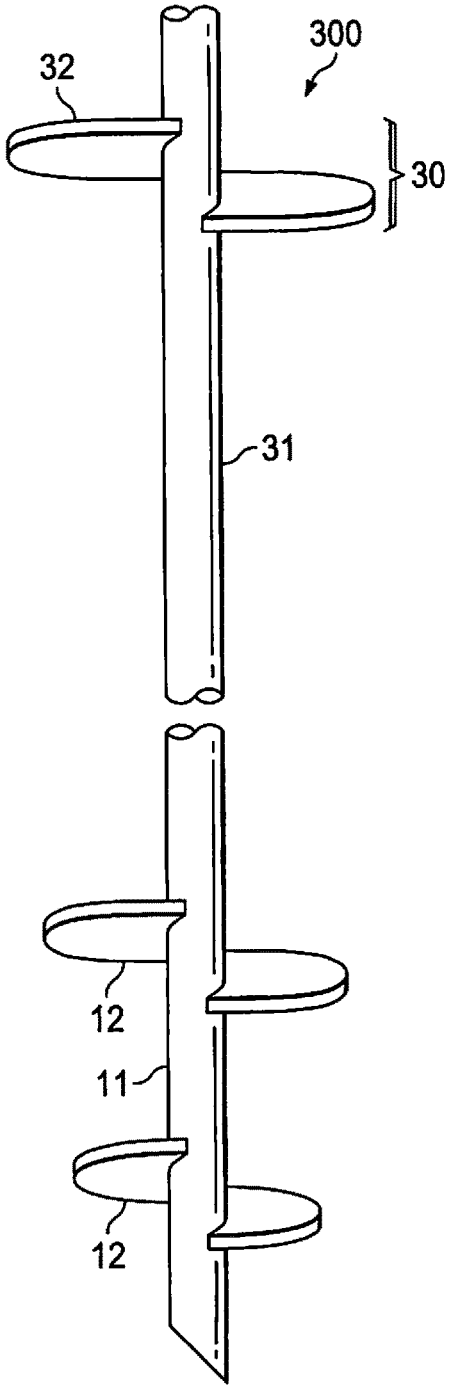
FIG. 3 shows a metal pier that includes a stabilizing plate as part of its structure, according to embodiments of the invention.

FIG. 3 shows a metal pier that includes a stabilizing device as part of its structure, according to embodiments of the invention. Instead of attaching a helix, or attaching a helix and shaft, to a pier, pier 300 is manufactured with helix 32. Similar to stabilizing device 20, pier 300 has helix 32 extending radially from shaft 31 for providing lateral stabilization support when helix 32 is disposed in active or unstable soil. In providing pier 300 with helix 32 at the outset, pier 300 is particularly applicable when the depth to which the pier will be installed is known. In this situation, the installation process may be designed so that the last shaft of a multi-shaft pier—the pier that is directly attached to the load (e.g. at the surface of the ground)—is a pier such as pier 300 that will dispose helix 32 in the upper unstable soil (e.g. 6 to 24 inches from the surface). For a single shaft pier, pier 300 may be installed without the extra step of having to attach a stabilizing device. In embodiments of the invention, a lateral force of 250-4,000 lbs. applied to a metal pier with an out-to-out dimension of 1 to 6 inches with a stabilizing device disposed in unstable soil is restricted to displacing the pier from 0 to 1 inch laterally.

Figure 4:
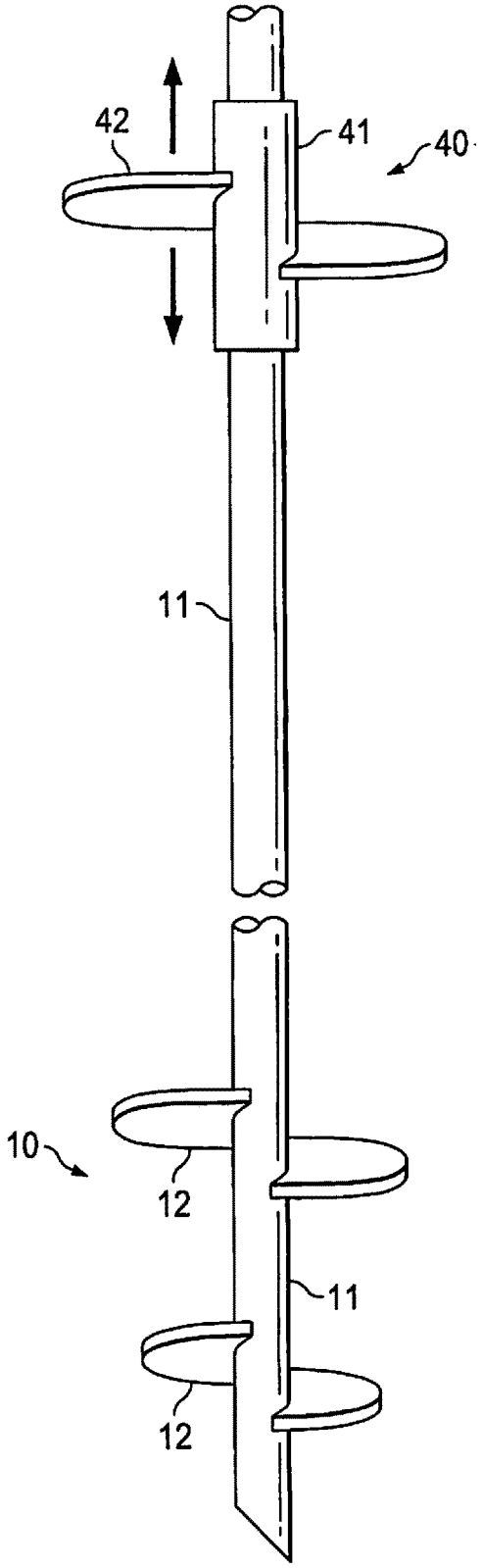
FIG. 4 shows a metal pier that includes a stabilizing device according to embodiments of the invention.

FIG. 4 shows a stabilizing device with a sleeve for placement over a pier according to embodiments of the invention. Stabilizing device 40 includes helix 42 attached to and extending radially from sleeve 41. Although sleeve 41 is shown as a hollow round pipe in FIG. 4, it should be noted that sleeve 41 does not have to be a round pipe over a round shaft 11. The configuration could be, for example, such that sleeve 41 is a round sleeve over a round or rectangular shaft 11 or sleeve 41 is a square sleeve over a round or square shaft 11. Different cross sectional shapes of sleeve 41 and shaft 11 are possible. Sleeve 41 is configured to have a larger cross section than shaft 11 of pier 10 such that sleeve 41 slides loosely over shaft 11 (fits around the perimeter of shaft 11). That is, shaft 11 fits into the hollow portion of sleeve 41. Sleeve 41 is configured to be open at both ends and, because of this, sleeve 41 is able to slide up and down over shaft 11 when a force parallel to the axis of sleeve 41 and shaft 11 (e.g. a vertical force when sleeve 41 and shaft 11 are vertical) is imposed on stabilizing device 40. For example, when stabilizing device 40 is disposed in unstable soil, expansion of the soil upwards imposes a vertical force on stabilizing device 40, in particular on helix 42. That force, however, does not get imposed on pier 10. Instead, the force imposed on stabilizing device 40 is expended in moving stabilizing device 40 upwards as sleeve 41 slides along shaft 11. Alternatively, only a negligible vertical force (e.g. 250 lbs.) applied to stabilizing device 40 is exerted on shaft 11.

When the unstable soil contracts, it will pull stabilizing device 40 down shaft 11, but does not impose, or imposes negligible downward force (e.g. 250 lbs.) on shaft 11. When lateral forces are imposed on pier 10, however, shaft 11 moves towards and contacts sleeve 41, and thereby imposes the lateral force on stabilizing device 40. In turn, stabilizing device 40 (particularly helix 42), in cooperation with the soil in which stabilizing device 40 is disposed prevents or minimizes lateral displacement of pier 10. In embodiments of the invention, a lateral force of 250 to 4000 lbs. applied to a pier of diameter 1 to 6 inches with a stabilizing device disposed in unstable soil is restricted to displacing the pier from 0 to 1 inch laterally.

Figure 16:
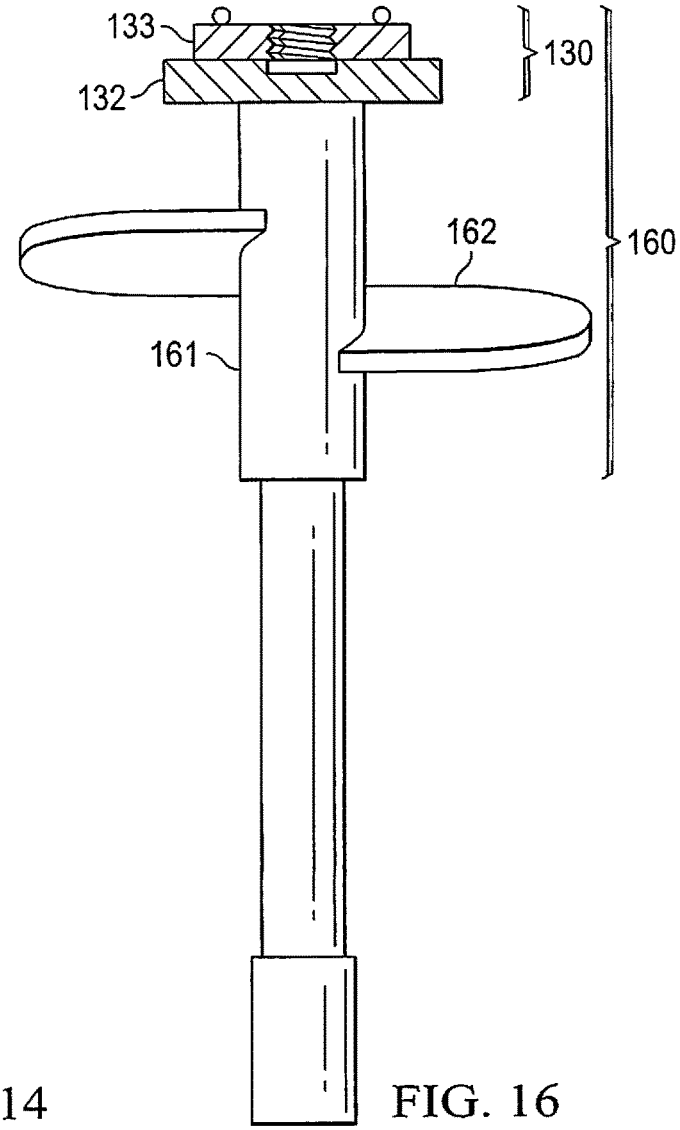
FIG. 16 shows a lifting mechanism and stabilizing device for attachment to a metal pier according to embodiments of the invention.

Any of the embodiments of stabilizing devices 20, 30, and 40, shown in FIGS. 2-4 may include a lifting mechanism at the top of the stabilizing device. FIG. 16 shows a lifting mechanism and stabilizing device for attachment to a pier according to embodiments of the invention. Stabilizing device 160 may be made of metal (e.g. different types of steel), composite materials (e.g., carbon fiber composites, engineered materials, etc.), polymers and/or the like, and combinations thereof. Stabilizing device 160 includes shaft 161 and helix 162. Helix 162 is a helix shaped plate that is substantially horizontal extending perpendicularly from shaft 161. Helix 162 is placed near the top of the ground in unstable soil, e.g. at the top of pier 10. Stabilizing device 160 may be attached to pier 10 by various means such as welding, bolting, etc. As shown, stabilizing device 160 may also include components of lifting device 130 (e.g. plates 132 and 133).

Figure 5:
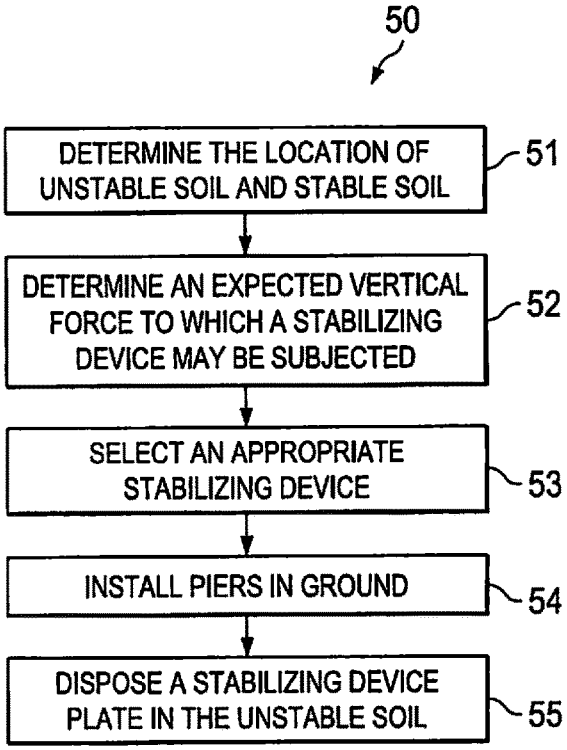
FIG. 5 shows process steps in a method for stabilizing a metal pier according to embodiments of the invention.

FIG. 5 shows process steps in a method for stabilizing a pier according to embodiments of the invention. Process 50 may begin at block 51, which includes determining the location of an unstable soil zone and a stable soil zone in the ground in which one or more piers are to be installed. For example, where it is known that the upper surface is clay (i.e. active soil), a determination is made as to how deep the clay extends below the surface. This determination may be made by analyzing soil core samples, examining geological data etc. or combinations thereof.

The various designs of stabilizing devices discussed herein resist upward forces from active soil at varying degrees. Consequently, block 52 of process 50 may involve, in some embodiments, determining, based at least on the properties of the soil, an expected vertical force to which a stabilizing device in the unstable region may be subjected in operation. The determination may be carried out by any of the following, for example: analyzing the soil from core samples, review geological surveys, running computerized models, and combinations thereof.

Based on the determination of the force expected on the stabilizing device, at block 53, process 50 may further include selecting an appropriate stabilizing device (including type of stabilizing plate). The stabilizing device may include any selection from the following list: a helix attached to the pier, a helix attached to a sleeve adapted to slide along the pier when subject to the expected vertical force, a plate attached to the pier and located parallel to the axis of the pier, a plate at an angle between 0° and 20° of the axis of the pier, a plurality of plates located parallel to the axis of the pier, and combinations thereof. Thus, embodiments of the invention may include a kit of different types of stabilizing devices adapted for selection, at least in part, based on an expected vertical force to which the stabilizing device will be subjected in operation. Additionally or alternatively, the configuration of the stabilizing device (including type of stabilizing plate) may be selected to provide a sufficient amount of lateral support, based on the type of soil (e.g. clay soil, sandy soil etc.). In sum, the selection of the configuration of the stabilizing device may include any combination of considerations of the vertical lift, the desired amount of lateral support, and the soil type.

Figure 6:
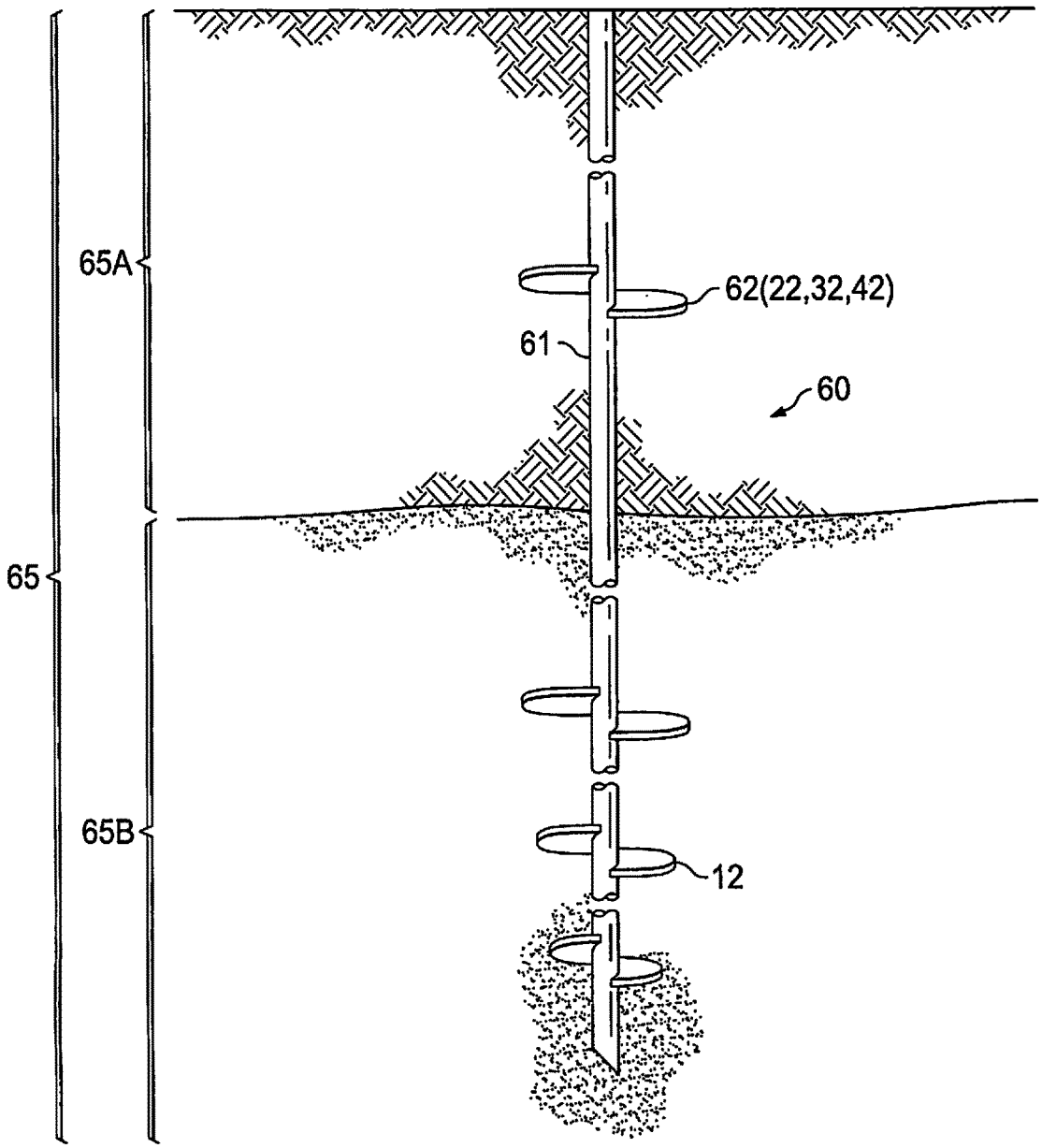
FIG. 6 shows a system for installing metal piers according to embodiments of the invention.

At block 54, piers 60 are installed into ground 65. FIG. 6 shows a system that may be used for installing a pier using, for example, process 50. As noted above, piers are installed in the ground to provide support to a structure. The installation may include driving a pier in the ground by downward force or screwing the pier in the ground by a torque (turning force) applied to shaft of the pier. When the pier is screwed in the ground (e.g. pier 10), that screwing is facilitated by helix 12. Hence the piers of some embodiments are made with helixes at the bottom of the pier.

As shown in FIG. 6, piers 60 include shaft 61 and helix 62. It should be noted that although only a single pier is shown in FIG. 6, the embodiments described herein may involve one or more piers. Helix 62 may be implemented as a part of pier 60 further to any of the methods described above with respect to helixes 22, 32, and 42. To install piers 60 in ground 65, a torque may be applied to shafts 61, which causes helixes 12 to dig into ground 65. Once sufficient torque is applied, piers 60 are drilled to a particular depth into stable soil region 65B. The depth is usually determined based upon the pre-determined depth of the stable region per a geotechnical soils test and the torque required to drill in helical piers 60 which is correlated to the load bearing capacity of helical piers 60 once installed. At this point, stable soil region 65B of ground 65 provides a resistance to vertical movement of piers 60 (including via helixes 12). In drilling into ground 65 with helixes 12, there is minimal disturbance of the soil around the top of helical piers 60. Further, as helixes 12 are turned, they do not compact the soil.

After or during piers 60 being installed in ground 65, at block 54, process 50 may include block 55 (disposing a stabilizing device in the unstable soil). At block 55, a stabilizing plate 62 (helix) is located in unstable soil region 65A of ground 65 to provide lateral support to pier 60. Locating stabilizing plate 62 in unstable soil region 65A may involve the implementations discussed above with respect to helix 22, 32, or 42, or combinations thereof. Thus, after or during the installation of pier 60 in the ground, implementing stabilizing plate 62 in unstable region 65A may involve attaching or installing helixes onto pier 60 in a manner similar to that described above with respect to helixes 22 and 42. Thus, in embodiments of the invention, attaching stabilizing plate 62 to pier 60 may include any of: clamping the stabilizing plates to pier 60; welding the stabilizing plates to pier 60; clamping a shaft, to which stabilizing plate 62 is attached (e.g. stabilizing device 20), to pier 60; welding a shaft, to which stabilizing plate 62 is attached (e.g. stabilizing device 20), to pier 60. Additionally, locating stabilizing plate 62 in unstable soil may involve installing a pier that has a helix, such as pier 300 described above. In this scenario, when there are a series of pier shafts installed to form a pier, the installation process may be implemented such that pier 300 is the upper most pier (last pier installed) in the series of piers.

In embodiments of the invention, locating stabilizing plate 62 in unstable region 65A may involve positioning a stabilization device such as stabilization device 40 in unstable region 65A. In this way, a sleeve to which stabilizing plate 62 is attached is positioned around shaft 11 by sliding it over shaft 11. The sleeve is adapted to move vertically along pier 60 when a vertical force in a predetermined range is imparted on stabilizing plate 62. Thus, vertical forces on stabilizing plate 62 do not push pier 60 upwards or pull pier 60 downwards. In scenarios where the axis of the pier is substantially vertical (at an angle 0°-6° to the vertical axis) stabilizing plate 62 works similarly. In these substantially vertical pier scenarios, the sleeve moves in the substantially vertical direction as it slides along shaft 11 (parallel to the axis of shaft 11). However, when lateral forces are applied to pier 60, pier 60 moves towards and make contact with the sleeve. In turn, the sleeve in cooperation with stabilizing plate 62 and surrounding soil stabilizes pier 60.

Unstable soil may be 10 feet, 15 feet, or even 20 feet deep. In embodiments of the invention, however, the stabilizing device may provide the greatest amount of lateral stabilization if it is close to the top of the pier. Therefore, in some embodiments stabilizing devices, e.g., 20, 30, 40, 60, 70, 80, 90, and 160 may be located at a depth of 2 feet or less from the surface of the ground. However, if the soil at the top is disturbed or loose, then the stabilizing devices m may be installed deeper. Thus, in some embodiments stabilizing devices, e.g., 20, 30, 40, 60, 70, 80, 90, and 160 may be located at a depth of 10 feet deep or less, 15 feet deep or less, or 20 feet deep or less.

In embodiments of the invention, disposing a helix in unstable soil, to provide lateral support, is made operationally possible by adjusting the characteristics of the helix (as compared with conventional helixes), or adding other features, or both. For example, the helix may have a steeper "rake" or pitch to present more of a vertical face to the soil (e.g. more surface area for the lateral support), the helix may be relatively smaller (e.g. smaller radius) so that it presents less of a horizontal face to the soil (e.g. less surface area for vertical lift), the helix may have appendages (e.g. a vertical edge surface or ring) to provide more lateral support, the like and combinations thereof. Further, the helix may be a multi-blade helix. Any of these features and combinations of features of helixes or stabilizing plates may be selected for application to a pier depending upon factors such as the type of soil (e.g. clay or sandy), diameter of pier etc. so that, in the resulting system, vertical forces are less than a predetermined threshold but nevertheless provides a desired or suitable amount of lateral support. For example, for sandy soil, the surface area of the helix exposed to soil laterally is not as critical as, for example for clay soil. Thus, helixes with more horizontal plates (smaller pitch) are more applicable in sandy soils while helixes with more vertical plates (larger pitch) are more applicable for clay soils. Thus, helixes 22, 32, and 42 are only one type of stabilizing plates according to embodiments of the invention as other types of stabilizing plates are possible.

Figure 7A:
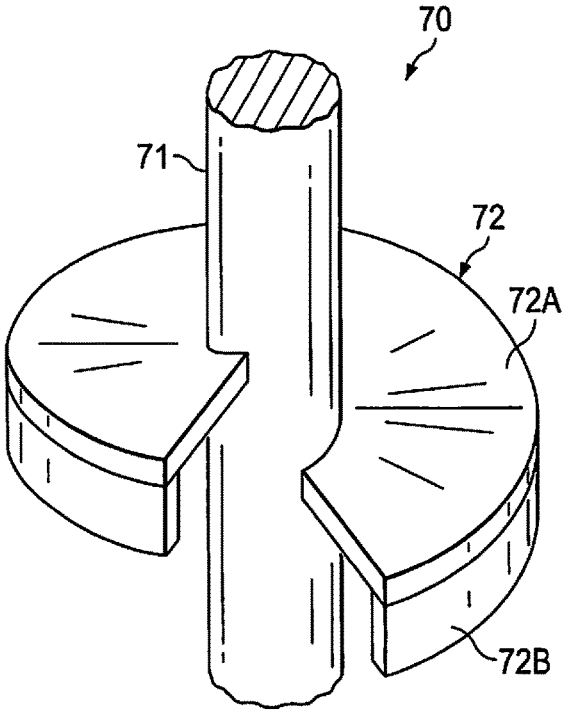
FIGS. 7A and 7B show stabilizing devices according to embodiments of the invention.
Figure 7B:
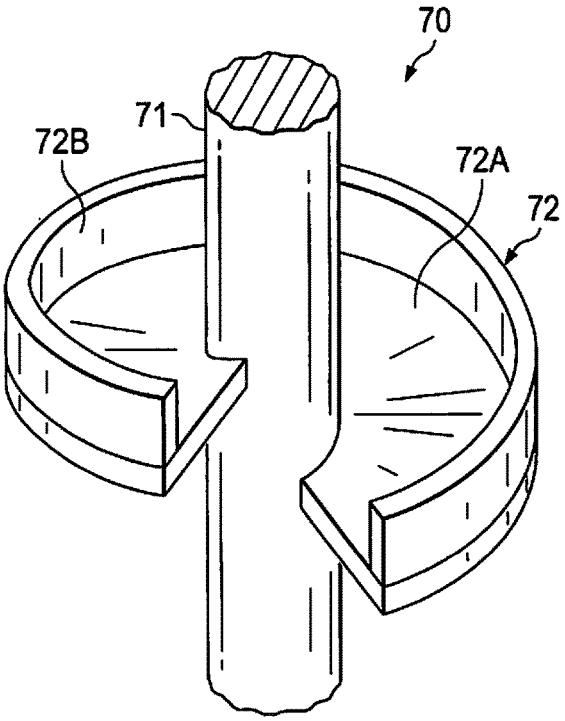

For example, FIGS. 7A and 7B show stabilizing device 70, according to embodiments of the invention. Stabilizing device 70 includes shaft 71 having helix 72A extending radially therefrom. In a manner similar to helix 22 of stabilizing device 20, helix 72A is disposed at a desired pitch on shaft 71. In addition, however, plate 72B extends from helix 72A (as an appendage or as a continuation of helix 72A) so that plate 72B extends vertically at the edge (perimeter) of helix 72A. In this way, stabilizing device 70 provides more lateral support for a pier than, for example, stabilizing device 20 (similarly configured but without a vertical plate). Plate 72B may be attached to the lower face of helix 72A, as shown in FIG. 7A or the upper face of helix 72B, as shown in FIG. 7B.

Figure 8:
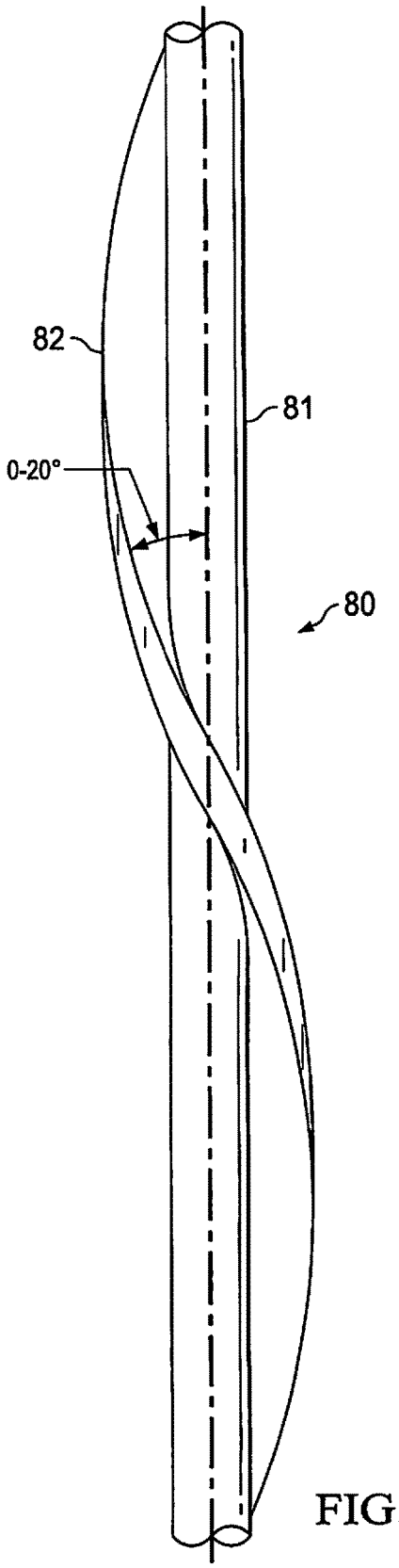
FIG. 8 shows a stabilizing device according to embodiments of the invention.

When the uplift loads in the soil are expected to be relatively significant, the stabilizing device may have its plate placed almost vertical (i.e. almost parallel to the axis of the pier). FIG. 8 shows such a stabilizing device (stabilizing device 80), according to embodiments of the invention. For stabilizing device 80, upward forces from the soil are exerted on a smaller surface area of stabilizing device 80 as compared with upward forces exerted on stabilizing device 20. With this substantially vertical configuration of the plate, not only is the vertical force component reduced but, in addition, the lateral support provided to the pier is increased. In embodiments, plate 82 is at an angle of 0°-20° of the axis of shaft 81 and of the axis of a pier to which shaft 81 is attached.

Figure 9A:
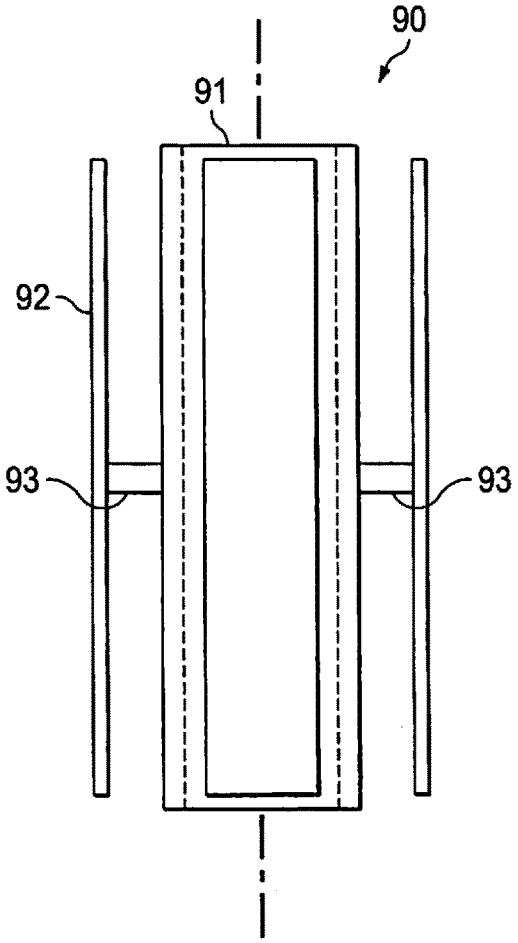
FIGS. 9A and 9B show a stabilizing device according to embodiments of the invention.
Figure 9B:
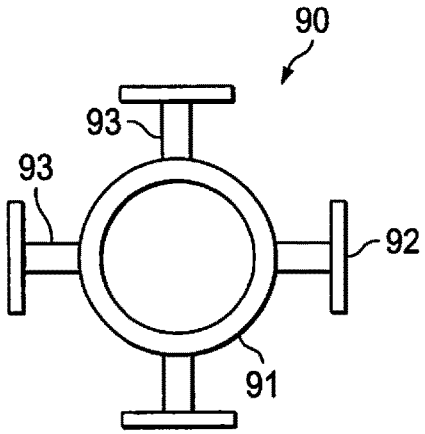

FIG. 9 shows another stabilizing device according to embodiments of the invention. FIG. 9 shows that stabilizing device 90 includes stabilizing plates 92 attached to shaft 91 by a connector 93. In embodiments of the invention, connector 93 may be a blade mounted with a pitch (e.g. each blade that would essentially be a cutout portion of a helix) so that the stabilizing device can be screwed in with the pier. Alternatively, connector 93 can be a vertical flat blade that can be driven into the ground with plate 92. Plates 92 are disposed parallel to the axis of shaft 91 (i.e. plates 92 are vertical if shaft 91 is vertical). Shaft 91 may be attached to pier 10 (so that vertical axis of pier 10 and shaft 91 are the same) to provide lateral stabilization of pier 10 or may be made to slide over shaft 11. The embodiments of the invention shown in FIGS. 7-9 may be made of metal (e.g. different types of steel), composite materials (e.g., carbon fiber composites, engineered materials, etc.), polymers and/or the like, and combinations thereof.

The various configurations of stabilizing devices described herein may be combined for implementation. For example, the vertical plate for additional lateral support described with respect to stabilizing device 70 of FIG. 7 may be combined with the sharply raked (large pitch) feature of stabilizing device 80, FIG. 8. Additionally, a single pier may have two different types of the stabilizing devices described herein. Further, different piers for a structure being supported may have different stabilizing devices depending on factors associated with each pier.

Figure 10:
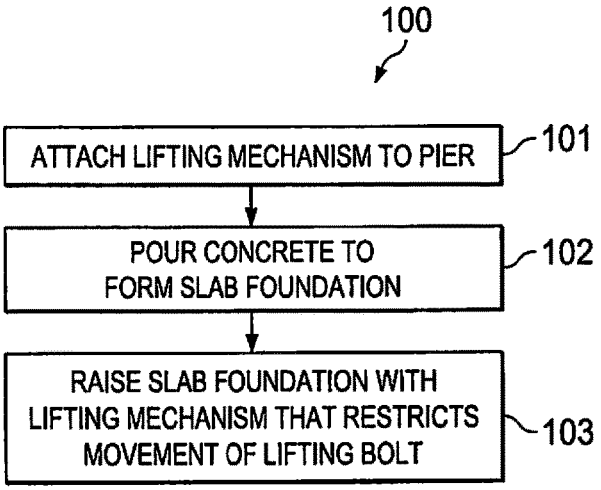
FIG. 10 shows process steps in a method for stabilizing a lifting bolt according to embodiments of the invention.

After piers 60 have been installed as shown in FIG. 6, the next steps may involve attaching a lifting mechanism to the pier, forming a foundation slab and then lifting the slab foundation. It should be noted that although embodiments described herein relates to a slab foundation as the structure being supported by piers, the present invention is not so restricted because, as mentioned above, the piers may be used to support several different types of structures. Thus, it should be understood that the present invention may be used with a variety of different types of structures that may require support. FIG. 10 shows a process of forming and lifting a slab foundation according to embodiments of the invention. It should be noted that process 100 may follow process 50. Thus, block 101 may involve attaching a lifting mechanism to pier 60, shown in FIG. 6. Different embodiments of lifting mechanisms are disclosed herein for attachment to pier 60. These lifting mechanisms are adapted to be placed on top of installed piers and within a structure that the piers support (e.g. a slab foundation of a building). The lifting mechanisms disclosed herein may be made of metal (e.g. different types of steel), composite materials (e.g., carbon fiber composites, engineered materials, etc.), polymers and/or the like, and combinations thereof.

Figure 12:
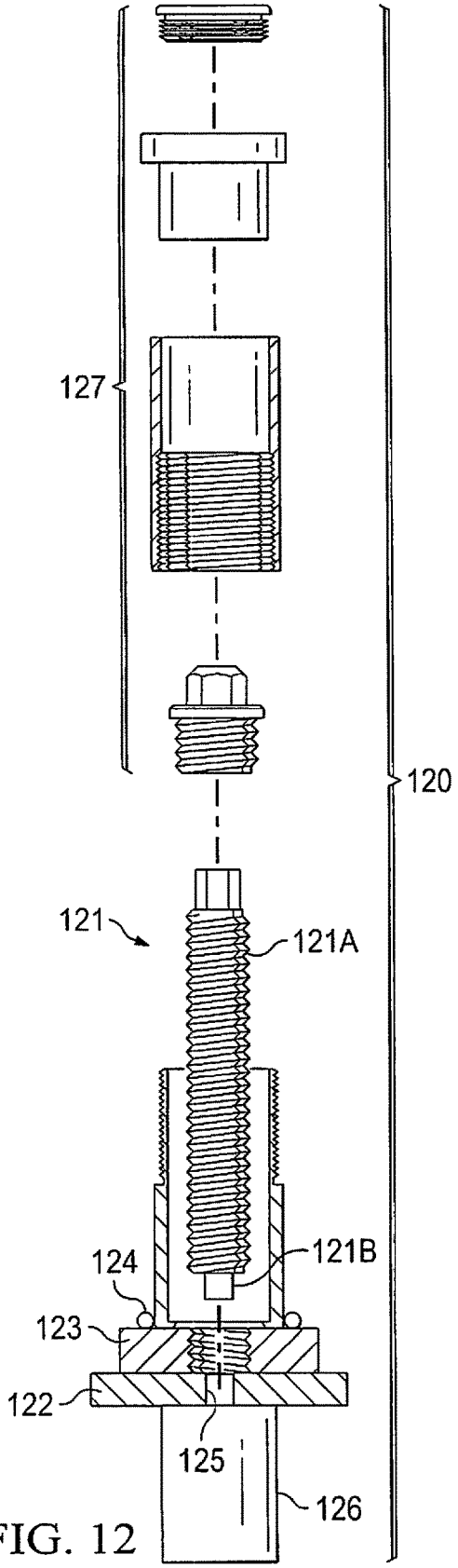
FIG. 12 shows a lifting mechanism according to embodiments of the invention.

FIG. 12 shows a first lifting mechanism according to embodiments of the invention. Lifting mechanism 120, adapted to be placed on top of installed piers and within a structure that the piers support, includes anchors 124, which secure lifting mechanisms 120 to the structure. Lifting mechanism 120 includes pipe 126, on which plate 122 is attached. Pipe 126 is attached to the pier. On top of plate 122, another plate, plate 123 is attached. The attachment between plate 122 and plate 123 is designed to break under a pre-determined load. Plate 123 is threaded to receive bolt 121, which is itself threaded. Lifting bolt 121 has a primary shaft, shaft 121A and a nub 121B. Nub 121B has a diameter smaller than the diameter of primary shaft 121A. Plate 122 has a recess area or hole 125, which is configured to receive nub 121B. Nub 121B and hole 125 are configured so that nub 121B fits in hole 125 such that the turning of lifting bolt 121 is not substantially impeded by the walls that define hole 125. However, the walls that define hole 125 restrict lateral displacement of the pier (to which lifting mechanism 120 is attached) which may occur during or after turning of lifting bolt 121 during the slab lifting process. In embodiments of the invention, such lateral movement is restricted to 1/16 inch from the pier's position prior to a torque being applied to lifting bolt 121. The pre-determined load under which the temporary attachment between plate 122 and plate 123 breaks is reached when lifting bolt 121 is screwed into plate 123, imparts a lifting force on plate 123, and imparts a downward force on plate 122. Protective sleeve 127 is designed and implemented to protect the other components of lifting mechanism 120.

Figure 13:
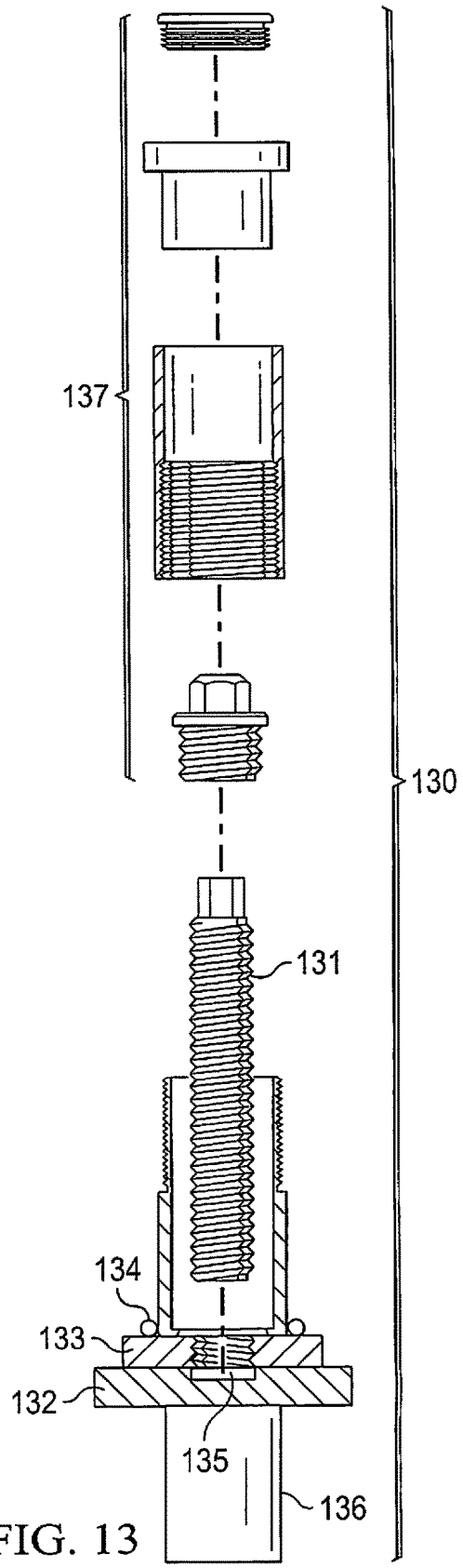
FIG. 13 shows a lifting mechanism according to embodiments of the invention.

FIG. 13 shows a second lifting mechanism according to embodiments of the invention. Lifting mechanism 130 is adapted to be attached to a pier and is similar to lifting mechanism 120, except that there is no nub in plate 132. Instead, plate 132 has recess area or hole 135 configured to receive and restrict lateral movement of a pier to which lifting mechanism 130 is attached. Similar to lifting mechanism 120, lifting mechanism 130 is adapted to be placed on top of installed piers and within a structure that the piers support (e.g. a slab foundation of a building). Anchors 124 secure lifting mechanism 130 to the structure being supported. Lifting mechanism 130 includes pipe 136, on which plate 132 is attached. Pipe 136 is attached to the pier. On top of plate 132, another plate 133 is attached. The attachment between plate 132 and plate 133 is designed to break under a pre-determined load. Plate 133 is threaded to receive bolt 131. As bolt 131 is turned in hole 135, the turning motion is not substantially impeded by the walls of hole 135. However, the walls that define hole 135 restrict lateral displacement of the pier (to which lifting mechanism 120 is attached) which may occur during or after turning of lifting bolt 131 during the lifting process. In embodiments of the invention, such lateral movement is restricted to 1/16 inch from lifting bolt 131's position prior to a torque being applied to lifting bolt 131. The pre-determined load under which the attachment between plate 132 and plate 133 breaks is reached when bolt 131 is screwed into plate 133 and exerts a lifting force on plate 133 and a downward force on plate 132. Protective sleeve 137 is designed and implemented to protect the other components of lifting mechanism 130.

Figure 14:
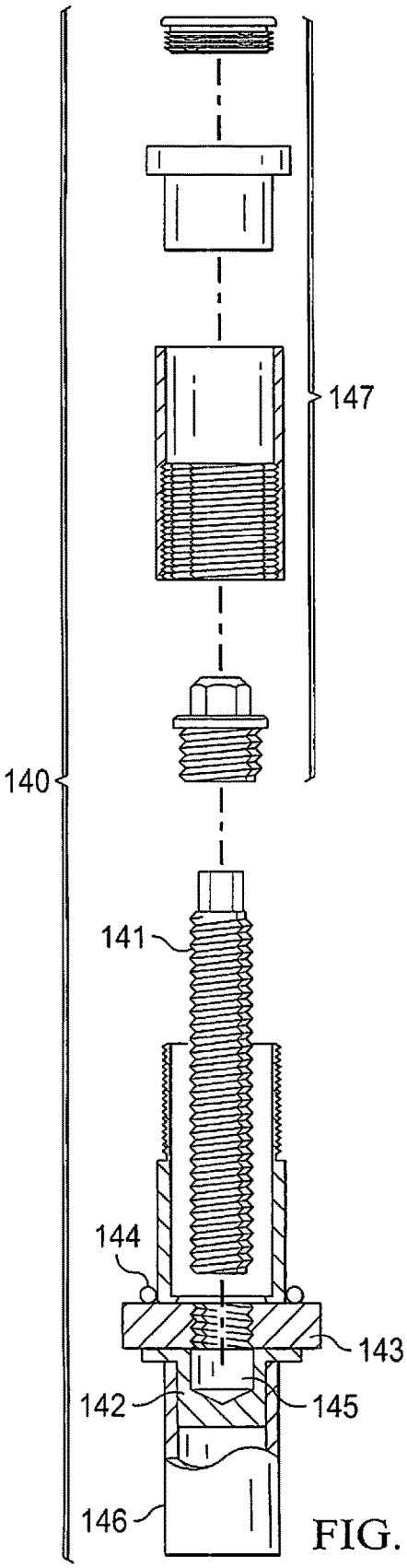
FIG. 14 shows a lifting mechanism according to embodiments of the invention.
Figure 15:
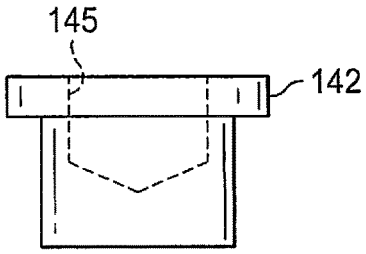
FIG. 15 shows a lifting plate according to embodiments of the invention.

FIG. 14 shows a third lifting mechanism according to embodiments of the invention. Lifting mechanism 140 is adapted to be attached to a pier and is similar to lifting mechanism 130, except that the hole for receiving bolt 141 is a cuplike receptacle embedded in shaft 11 of a pier, when shaft 11 and the pier are hollow. Cuplike plate 142 has a recessed area that defines hole 145 for receiving bolt 141. Plate 143 is attached to cuplike plate 142. Lifting mechanism 140, adapted to be placed on top of installed piers and within a structure that the piers support, includes anchors 144 to secure lifting mechanism 120 to the structure. The attachment between plate 142 and plate 143 is designed to break under a pre-determined load. Plate 143 is threaded to receive bolt 141. As bolt 141 is turned in hole 145, the walls that define hole 145 does not impede the turning motion of bolt 141. However, the walls that define hole 145 restrict the lateral movement of the pier as bolt 141 turns or after such turning is complete. In embodiments of the invention, such lateral movement is restricted to 1/8 inch from the pier's position prior to a torque being applied to bolt 141. The pre-determined load under which the attachment between cuplike plate 142 and plate 143 breaks is reached when bolt 141 is screwed into plate 143, exerts a lifting force on plate 143, and exerts a downward force on plate 142. FIG. 15 shows cuplike plate 142 in detail. Cuplike plate 142 is a receptacle with dimensions such that it fits in a hole in the center of pipe 146. The walls of cuplike plate 142 form a recessed area, hole 145 such that bolt 141 fits within hole 145.

Figure 11:
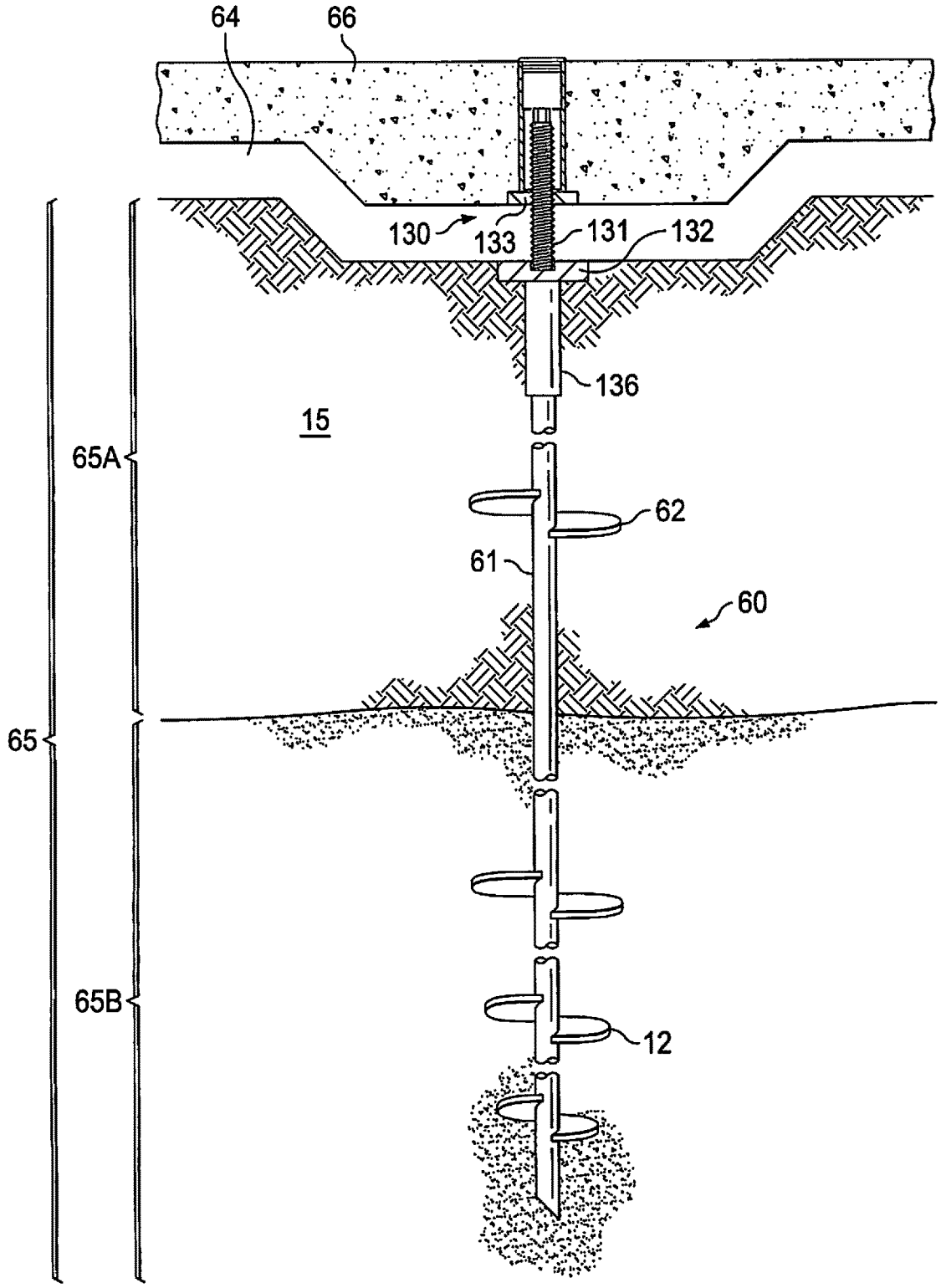
FIG. 11 shows a system for installing a metal pier according to embodiments of the invention.

Returning to process 101, FIG. 10, after a lifting mechanism such as lifting mechanism 120, 130, or 140 is attached to pier 60, at block 102, concrete is then poured within form boards that define the perimeter of the slab foundation 66. FIG. 11 illustrates the lifting of a slab when lifting mechanism 130 is used as the lifting mechanism (however, the process applies equally well to lifting mechanisms 120 and 140). The concrete is allowed to cure. As the concrete cures and strengthens, it becomes fixed to lifting mechanism 130

To raise the slab foundation, at block 103, lifting mechanism 130 is actuated by applying a torque to lifting bolt 131. Bolt 131 enters plate 133 as the threads of plate 133 and lifting bolt 131 align. Lifting bolt 131 is screwed into plate 133 until it impacts plate 132, applies a downward force on plate 132, and applies an upward force on plate 133, until plate 132 detaches from plate 133. At this point, lifting bolt 131 starts lifting slab 66. As further torque is applied, lifting bolt 131 lifts slab 66 to a desired height, creating void 64, as shown in FIG. 11. Significantly, plate 132 restricts the lateral movement of plate 132 and thereby ensures that lateral displacement and possible buckling of pier 10 and damage to slab 66 are avoided.

FIG. 11 also illustrates that because void 64 has been created under slab foundation 66 and ground 65 can expand into void 64. Thus, the expansion of ground 65 does not exert an upward force on slab foundation 66. In embodiments of the invention, void 64 may be left empty or may be filled with a loose-fill material that will allow ground 65 to expand and contract without imposing expansion and contraction forces on slab foundation 66. The loose-fill material may include packaging and cushioning material (e.g. foam peanuts), and/or the like, and combinations thereof. The foam peanuts (also known as packing peanuts or Styrofoam popcorn) are normally used to protect fragile objects. Filling void 64 with loose-fill material prevents, for example, rodents from occupying void 64. Further, having peanut foam in void 64 reduces the amount of air present in the void and thereby limits the amount of oxygen available to corrode metallic parts of pier 10, lifting mechanism 130, or slab foundation 66.

Figure 1:
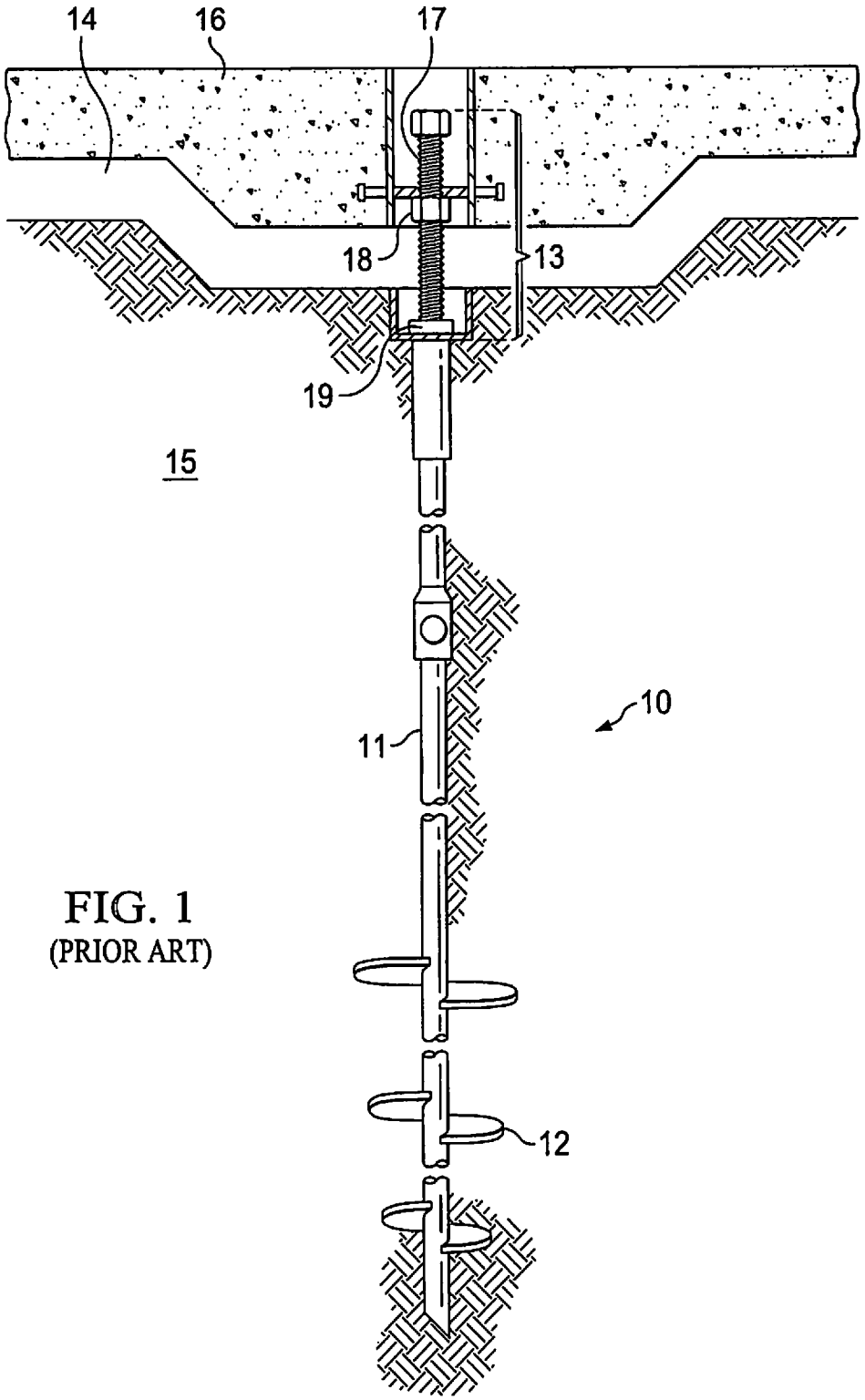
FIG. 1 (PRIOR ART)
FIG. 1 shows a prior art system for suspending slab foundations.
Figure 17:
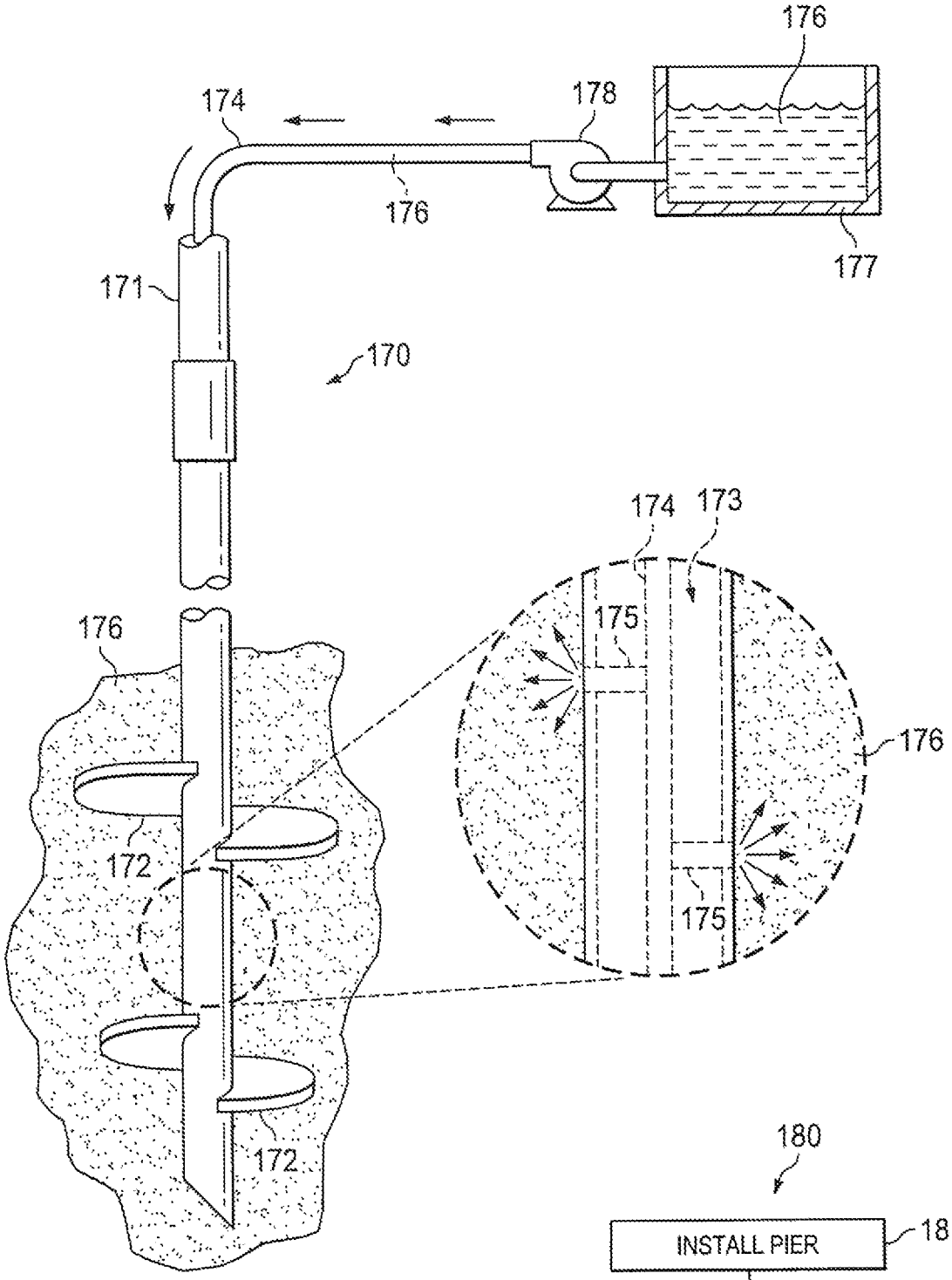
FIG. 17 shows a metal pier with a stabilizing fluid injection system according to embodiments of the invention.

FIG. 17 shows pier 170, which includes a stabilizing fluid injection system, according to embodiments of the invention. Pier 170 may be made of metal (e.g. different types of steel), composite materials (e.g., carbon fiber composites, engineered materials, etc.), polymers and/or the like, and combinations thereof. Pier 170 includes shaft 171 and helix 172. As shown in FIG. 17, pier 170 has some similarities to pier 10 (FIG. 1) in that helixes 172 allows pier 170 to be drilled into the ground. However, according to embodiments of the invention, shaft 171 is a pipe with hollow area 173. Hollow area 173 has tube 174 and injector 175 disposed in it. Tube 174 leads from storage 177, which stores stabilizing fluid 176. It should be noted that pier 170 might be hollow or solid. If pier 170 is hollow, a tube (such as tube 174) can be inserted in the hollow pier to carry the fluid. If pier 170 is solid, a channel can be drilled in the solid material to carry fluid 176.

Figure 18:
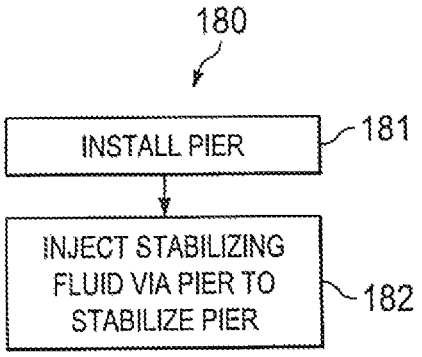
FIG. 18 shows process steps in a method for stabilizing a metal pier according to embodiments of the invention.

FIG. 18 shows method 180 according to embodiments of the invention, for installing, for example, pier 170. Method 180 may begin at block 181 with the installing of pier 170 in the ground according to methods described herein or other methods. At block 182, stabilizing fluid 176 (e.g. water, chemicals, other materials, or combinations thereof) is injected into the soil at least immediately around pier 170.

In this injection process, stabilizing fluid 176 may be pumped by pump 178 from storage 177 through tube 174 downwards through pier 170, as shown in FIG. 17. Tube 174 may be pressurized with stabilizing fluid 176. From tube 174, stabilizing fluid 176 flows through soil injectors 175, which leads from tube 174 through shaft 171. It should be noted that tube 174 and injectors 175, instead of being different tubes in fluid communication, may include a single tube with branches along the tube, which leads through shaft 171 to the soil. When stabilizing fluid 176 is introduced into soil, in at least the immediate environs of pier 170, it modifies a property of the soil around pier 170 to stabilize pier 170. For example, for clay, stabilizing fluid 176 prevents the clay from expanding and contracting with changes in the amount of water present in the clay.

In contrast to conventional systems, embodiments of the invention, via soil injectors 175, allow for the injection of stabilizing fluid at different depths in the soil, without moving the injecting the apparatus to various different depths. This is possible because soil injectors 175 may be located at different points along the length of pier 170.

When stabilizing fluid is injected in the soil via tube 174 and soil injectors 175, through pier 170, the stabilizing fluid is efficiently dispersed into soil that is in immediate contact with pier 170 and beyond. Thus, the stabilizing fluid is dispersed precisely in the areas required to stabilize pier 170. By injecting the stabilizing fluid exactly where it is needed, it is possible to use just enough stabilization fluid, i.e. treating the soil only where it is necessary to do so. Thus, embodiments of the invention provide a process of injecting soil stabilizing fluid that is effective and inexpensive. In embodiments of the invention, stabilizing fluid is injected so that it is dispersed up to 2 feet from pier 170 in multiple directions.

Typically, one application of stabilizing fluid to the soil is sufficient to stabilize the soil for a long period. However, in embodiments of the invention, because pier 170 is a permanent support to a structure, having tube 174 and soil injectors 175 disposed in pier 170 allows for repeat injection of stabilizing fluid, for example, after an initial application and after the structure being supported is in place. This avoids the burden of having to reinsert injection rods to inject stabilizing fluid after a first application. Indeed, in the case where rods need to be reinserted in the soil, it may not be possible to do so easily because the structure being supported covers the surface of the soil where the injection rods would be inserted. For example, if the piers are supporting the foundation of a house, reapplying stabilization fluids may require drilling an access hole in the foundation, which is often inconvenient and expensive.

Figure 19:
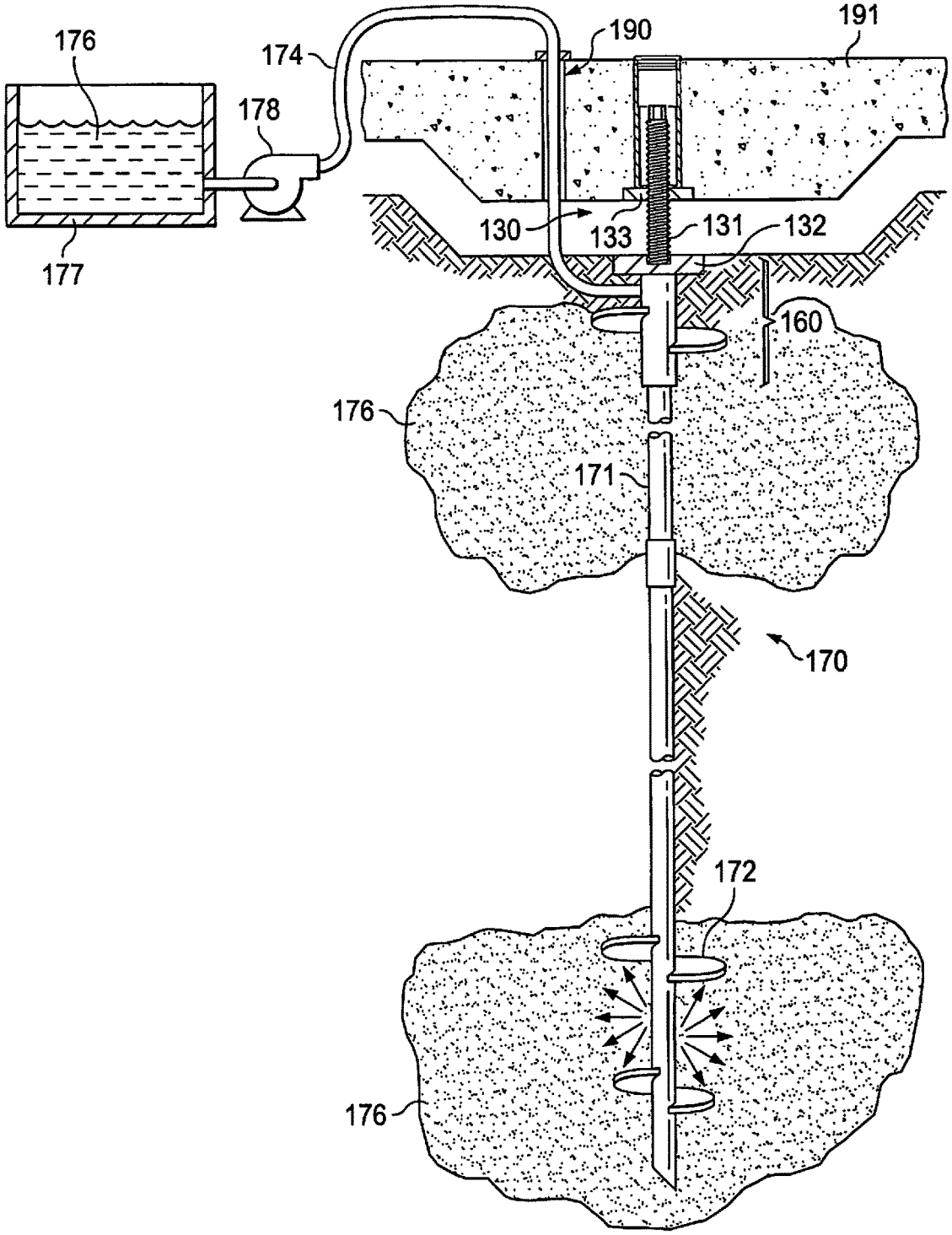
FIG. 19 shows a system for stabilizing a metal pier according to embodiments of the invention.

In embodiments of the invention, to facilitate applications of stabilizing fluid 176 after a after pier 170 and the structure it supports have been installed, appropriately placed stabilizing fluid supply channels may be implemented to be in fluid communication with tube 174 so as to provide an easy way for pumping stabilizing fluid 176 in the ground. FIG. 19 shows such a system for injecting stabilizing fluid to stabilize pier 170. FIG. 19 shows pier 170 installed in the ground. FIG. 19 shows foundation 191 on top of and attached to pier 170. Because foundation 191 covers a significant area around pier 170, it is difficult to access the soil around pier 170. Thus, treating the soil with stabilizing fluid 176 after foundation 191 has been formed is difficult. To avoid this difficulty, embodiments of the invention provide for supply channels disposed in foundation 191. In this way, there is no need to drill through foundation 191 to access tube 174. It should be noted that supply channels could also be placed under foundation 191 in void 64. For example, tubes may be run under foundation 191 to the sides of foundation 191 and can be accessed at a future date without disturbing foundation 191 or contents inside the structure.

According to embodiments of the invention, a pipe is positioned to be in fluid communication with tube 174, in the area in which foundation 191 will be formed, prior to the concrete being poured to form foundation 191. In this way, the concrete sets around the pipe to provide supply channel 190 within foundation 191. It should be noted, however, that supply channel 190 may be created in other ways. With channel 190 disposed in foundation 191, stabilizing fluid may be pumped through channel 190 to tube 174, then to injectors 175 and into the soil. According to embodiments of the invention, supply channel 190 may be provided so that injection of stabilizing fluid may occur after foundation 191 is created and attached to pier 170 and even after a structure, e.g. a house, is built on top of foundation 191. Thus, according to embodiments of the invention, having channel 190 and an injection system disposed in pier 170 allow for a system that uses pier 170 to support foundation 191 and, at the same time, stabilize pier 170 by stabilizing soil, in which pier 170 is disposed. The stabilizing of the soil can be carried out either by injecting stabilizing fluid 176 when pier 170 is initially installed and prior to pier 170 supporting foundation 191 being installed, or injecting stabilizing fluid 176 after foundation 191 has been installed, or both. Thus, embodiments of the invention provide a hassle-free system of initial and subsequent injection of stabilizing fluid 176 into soil around pier 170.

In embodiments of the invention, tube 174 and soil injectors 175 may be of different orientations, shapes and sizes. For example, tube 174 and soil injectors 175 could have, for example, a cross section that is circular, ellipsoidal, square, rectangular, or combinations thereof. Tube 174 and soil injectors 175 may be made of different types of material such as metal (e.g. different types of steel), composite materials (e.g., carbon fiber composites, engineered materials, etc.), rubber, polymeric materials (e.g. plastic) and/or the like, and combinations thereof. As noted above, any type of stabilizing fluid may be used in embodiments of the invention; but based on the stabilizing fluid used, embodiments of the invention may involve selecting the most appropriate type and configuration of tube 174 and injectors 175. For example, if the stabilizing fluid is corrosive, materials that resist corrosion may be used to make tubes 174 and injectors 175.

Tube 174 and soil injectors 175 and the injection of stabilizing fluid 176 may be implemented in one or more piers that support a structure, as needed. Further, stabilizing piers by stabilizing the soil around the pier, as described herein, may be implemented in combination with one or more of the other methods of stabilizing a pier described herein. For example, stabilizing pier 170, which includes tube 174 and soil injector 175 in hollow section of pier 170 to inject stabilizing fluid in the soil, may be implemented with any of stabilizing devices 20, 30, 40, 70, 80, 90, or combinations thereof on pier 170.

It should be noted that the feature or features of one embodiment may be applied to other embodiments, even though not described or illustrated, unless expressly prohibited by this disclosure or the nature of the embodiments.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps. Moreover, the scope of the present application is not intended to be limited to the particular embodiments of the process, machine, manufacture, composition of matter, means, methods and steps described in the specification.

What is claimed is:

1. A lifting mechanism disposed on a pier for lifting a slab foundation above ground; the lifting mechanism comprising:

a lifting bolt;

apparatus configured to restrict lateral displacement of the pier when a torque is applied to the lifting bolt to raise the slab foundation; and a plate connected to the apparatus using a connection configured to break under a predetermined load, wherein the plate is threaded to receive the lifting bolt.

2. The lifting mechanism of claim 1 wherein the apparatus comprises:

a receptacle with dimensions such that the receptacle fits in a hole in the center of the pier and wherein walls of the receptacle form a recessed area such that the lifting bolt fits within the recessed area of the receptacle, wherein the receptacle is connected directly or indirectly to the pier, wherein the receptacle and walls of the recessed area in cooperation with the lifting bolt stabilize the pier by preventing the pier from displacing more than a predetermined distance from its axis prior to, during or after application of the torque.

3. A device for interfacing a hollow pier and a lifting bolt of a lifting mechanism, the device comprising:

a first section configured to fit within the hollow pier laterally adjacent to a wall of the hollow pier;

a second section being wider than the first section and wider than a hollow section of the hollow pier such that the second section rests longitudinally on the wall of the hollow pier when the first section is within the hollow section of the hollow pier, wherein the device has a recessed area configured to receive the lifting bolt; and a plate connected to the second section, wherein the plate is threaded to receive the lifting bolt, and wherein a connection between the plate and the second section is configured to break under a predetermined load.

4. The device of claim 3, wherein the lifting mechanism is configured to lift a structure away from the hollow pier.

5. The device of claim 4, wherein the structure comprises a slab foundation.

6. The device of claim 5, wherein the device comprises a cuplike receptacle.

7. The device of claim 3, wherein the predetermined load exerted when the lifting bolt is screwed into the plate such that it applies a force downwards on the second section and a force upwards on the plate.

8. A method of lifting a structure by a lifting mechanism disposed on a hollow pier, the method comprising:

restricting lateral movement of the hollow pier as torque is applied to a lifting bolt of the lifting mechanism, wherein the restricting comprises:

providing a device for interfacing the hollow pier and the lifting bolt of the lifting mechanism;

placing a first section of the device to fit within the hollow pier laterally adjacent to a wall of the hollow pier; and positioning a second section of the device such that the second section rests longitudinally on the wall of the hollow pier, wherein the second section is wider than the first section and wider than a hollow section of the hollow pier, wherein the device has a recessed area configured to receive the lifting bolt;

providing a plate connected to the second section, wherein the plate is threaded to receive the lifting bolt;

turning the lifting bolt so that the lifting bolt is received in the recessed area; and breaking a connection between the plate and the second section by exerting a predetermined load when the lifting bolt is screwed into the plate such that lifting device applies a force downwards on the second section and a force upwards on the plate.

9. The method of claim 8, wherein the lateral movement of the hollow pier is restricted to ⅛ inch from the hollow pier's position prior to a torque being applied to the lifting bolt.

10. The method of claim 8, wherein the structure comprises a slab foundation.

11. The method of claim 8, wherein the device comprises a cuplike receptacle.

* * * * *